US007484715B2

(12) United States Patent
Hoffend, Jr.

(10) Patent No.: US 7,484,715 B2
(45) Date of Patent: Feb. 3, 2009

(54) MODULAR LIFT ASSEMBLY HAVING TELESCOPING MEMBER

(75) Inventor: Donald A. Hoffend, Jr., Pittsford, NY (US)

(73) Assignee: Daktronics Hoist, Inc., Brookings, SD (US)

( * ) Notice: Subject to any disclaimer, the term of this patent is extended or adjusted under 35 U.S.C. 154(b) by 426 days.

(21) Appl. No.: 11/410,128

(22) Filed: Apr. 24, 2006

(65) Prior Publication Data

US 2007/0246695 A1 Oct. 25, 2007

(51) Int. Cl.
*B66D 3/08* (2006.01)

(52) U.S. Cl. ..... 254/393; 472/79; 212/98; 403/387; 403/385; 248/72; 248/228.3; 248/228.5; 52/127.5

(58) Field of Classification Search ..... 254/278, 254/389, 393, 394, 395; 160/144; 472/77, 472/78, 79; 212/200, 83, 98; 403/387, 384, 403/385; 248/228.1, 72, 228.5, 228.3; 52/127.5
See application file for complete search history.

(56) References Cited

U.S. PATENT DOCUMENTS

| | | | | | |
|---|---|---|---|---|---|
| 559,539 | A | * | 5/1896 | Reynolds | 403/400 |
| 977,499 | A | | 12/1910 | Bailey | |
| 977,500 | A | | 12/1910 | Bailey | |
| 1,132,999 | A | * | 3/1915 | Beers | 248/62 |
| 1,263,628 | A | | 4/1918 | Vallen | |
| 1,340,066 | A | | 5/1920 | Lemle | |
| 1,473,336 | A | | 11/1923 | Connelly | |
| 1,821,563 | A | | 9/1931 | Mitchell et al. | |
| 2,357,462 | A | | 9/1944 | Ferguson | |
| 2,507,783 | A | * | 5/1950 | Graham | 403/387 |
| 2,649,279 | A | | 8/1953 | Jones et al. | |
| 2,877,974 | A | * | 3/1959 | Estes | 248/228.3 |
| 4,033,539 | A | * | 7/1977 | Bardocz | 248/228.6 |
| 4,046,235 | A | | 9/1977 | Shutt | |
| 4,062,519 | A | | 12/1977 | Jacobs | |
| 4,090,692 | A | * | 5/1978 | Jacobs | 472/78 |
| 4,156,521 | A | | 5/1979 | Harman | |
| 4,251,059 | A | | 2/1981 | Fougea | |

(Continued)

FOREIGN PATENT DOCUMENTS

DE 255 522 4/1988

(Continued)

OTHER PUBLICATIONS

Cyclorama Batten Systems, Regional Performing Arts Center, Philadelphia, PA. Dec. 15, 1999.

(Continued)

*Primary Examiner*—Emmanuel M Marcelo
(74) *Attorney, Agent, or Firm*—Hugh D. Jaeger, Esq.

(57) ABSTRACT

A modular lift assembly configured for attachment between two substantially parallel support beams includes a chassis, at least one lift component attached to the chassis, a telescoping stiffener, and at least one attachment assembly. The chassis has a plurality of grooves formed in one surface thereof. The telescoping stiffener is disposed in at least one of the grooves and engages facing surfaces of adjacent parallel support beams. The attachment assembly is disposed in another of the grooves formed in the chassis for engaging at least one of the adjacent support beams.

22 Claims, 9 Drawing Sheets

U.S. PATENT DOCUMENTS

| | | | | |
|---|---|---|---|---|
| 4,324,386 | A | 4/1982 | Gagnon et al. | |
| 4,371,203 | A * | 2/1983 | Munro | 294/119.1 |
| 4,379,651 | A * | 4/1983 | Nagashima | 403/387 |
| 4,446,587 | A | 5/1984 | Jump | |
| 4,558,521 | A * | 12/1985 | Steck et al. | 33/533 |
| 4,600,085 | A * | 7/1986 | Gagnon et al. | 187/268 |
| 4,606,527 | A | 8/1986 | Ziller et al. | |
| 4,662,628 | A | 5/1987 | Chatenay epouse Compagnone | |
| 4,772,923 | A | 9/1988 | Lein | |
| 4,802,787 | A | 2/1989 | Bays | |
| 5,031,574 | A | 7/1991 | McDowell | |
| 5,141,085 | A | 8/1992 | McCormick | |
| 5,361,565 | A | 11/1994 | Bayer | |
| 5,711,713 | A | 1/1998 | Krueger | |
| 6,080,981 | A | 6/2000 | Payne | |
| 6,364,062 | B1 | 4/2002 | Ericson et al. | |
| 6,494,642 | B1 * | 12/2002 | Daly | 405/36 |
| 6,520,485 | B1 | 2/2003 | Soot | |
| 6,520,705 | B2 * | 2/2003 | Stasney, Jr. | 403/258 |
| 6,634,622 | B1 | 10/2003 | Hoffend, Jr. | |
| 6,691,986 | B2 | 2/2004 | Hoffend | |
| 6,889,958 | B2 | 5/2005 | Hoffend | |
| 6,988,716 | B2 | 1/2006 | Hoffend | |
| 6,997,442 | B2 | 2/2006 | Hoffend | |
| 2003/0030045 | A1 | 2/2003 | Hoffend | |
| 2003/0111652 | A1 | 6/2003 | Hoffend | |
| 2004/0084665 | A1 | 5/2004 | Hoffend | |
| 2004/0098944 | A1 | 5/2004 | Hoffend | |
| 2004/0099852 | A1 | 5/2004 | Hoffend | |
| 2004/0183060 | A1 | 9/2004 | Hoffend | |
| 2005/0247919 | A1 | 11/2005 | Hoffend | |
| 2006/0163548 | A1 * | 7/2006 | Kochan et al. | 254/278 |
| 2006/0169662 | A1 | 8/2006 | Hoffend | |

FOREIGN PATENT DOCUMENTS

| | | |
|---|---|---|
| DE | 37 37 612 | 6/1989 |
| DE | 42 04 153 | 8/1993 |
| DE | 299 12 572 U1 | 9/1999 |
| EP | 0 540 136 | 5/1993 |
| EP | 0 778 239 | 6/1997 |
| FR | 2 689 415 | 10/1993 |

OTHER PUBLICATIONS

English Abstract of publication DE 37 37 612.
English Abstract of publication DE 42 04 153.
English Abstract of publication FR 2 689 415.

* cited by examiner

-- PRIOR ART --

--PRIOR ART--

-- PRIOR ART --

MODULAR LIFT ASSEMBLY HAVING TELESCOPING MEMBER

BACKGROUND OF THE INVENTION

1. Field of the Invention

The present invention relates to lift and hoist mechanisms, more particularly, to a lift assembly that can be employed for raising and lowering a batten in theatrical and staging environments, wherein the lift assembly is a modular self contained unit that can be readily and securely installed in a wide variety of building configurations.

2. Description of Related Art

Performance venues such as theaters, arenas, concert halls, auditoriums, schools, clubs, convention centers and television studios employ battens or trusses to suspend lighting, scenery, drapery and other equipment which is moved relative to a stage or floor. These battens usually include pipe or joined pipe sections that form a desired length of the batten. The battens can be fifty feet or more in length. To support heavy loads, or where suspension points are spaced fifteen to thirty feet apart, the battens may be fabricated in either ladder, triangular or box truss configurations.

Battens often need to be lowered for exchanging and servicing the suspended equipment. To reduce the power necessary to raise and lower the battens, the battens are often counterweighted. The counterweights reduce the effective weight of the battens and any associated loads.

A number of elevating or hoisting systems are available for supporting, raising and lowering battens. One of the most common and least expensive batten elevating systems is a counterweighted carriage that includes a moveable counterweight for counterbalancing the batten and equipment supported on the batten.

Another common elevating or hoisting system employs a winch to raise or lower the battens. The winch may be either hand or electrically operated. Occasionally in expensive operations, a motorized winch or hydraulic or pneumatic cylinder device is used to raise and lower the batten.

More recently, modular lift assemblies have been employed to raise and lower battens. An example of such a conventional assembly is shown in FIGS. 1A-1C.

In the conventional lift assembly 1, a motor 4 is disposed in communication with a drum 6 such that the motor 4 rotates the drum 6. One or more wire cables 8 are wound around the drum 6 such that as the drum 6 rotates, the cables 8 are selectively wound about, or advanced from, the drum 6. A plurality of pulleys 10 is disposed to reroute and redirect the cables 8 as they are extended from the drum 6. In this manner, cables 8 extend generally horizontally from the lift assembly 1 before being rerouted vertically to attachment points on a batten 12 to be raised or lowered. The lift assembly preferably also includes a frame 14 that houses the drum 6 and motor 4, as well as other components comprising the lift assembly. The frame 14 is preferably mountable to I-beams (or similar support structures) 16 native to the arena in which the lift assembly 1 is to be used.

Such conventional lift assemblies 1 have revolutionized the way in which battens are raised and lowered. However, because the frame 14 is normally suspended from I-beams or other support structures, the frame is required to withstand a vertical load caused by the weight of the assembly and the weight of the object to be raised or lowered. Moreover, when the wire cables 8 are lead horizontally from the lift assembly and then dropped vertically to the batten 12, the assembly is also subject to a horizontal load. The vertical and horizontal loads may result in sagging or drooping at positions furthest from the support structures and relative bending with respect to the support structure 16 nearest the end of the lift assembly from which the cables 8 extend. These loads are further exacerbated when the weight of the battens is increased and when the distance between points at which the lift assembly is attached to the support structure is increased.

Such loads may result in deformations of the lift assembly, which may maliciously affect components of the lift assembly. For example, a shaft (not shown) driven by the motor 4 to rotate the drums 6 about which the cables 8 are wound may be up to seven feet in length, and even slight bending thereof may cause misalignment of the shaft with respect to bearings (not shown) in which the shaft rotates. As a result, a wobble of the rotating components with respect to each other is created, potentially shortening the life of the bearings, shaft, and/or drums, and increasing noise created by the lift assembly.

Thus, there is a need in the art for an improvement to existing modular lift assemblies, which improvement provides increased stiffness of the lift assembly to increase the life and efficiency of the assembly.

There is also a need in the art for an improvement to existing modular lift assemblies, which improvement provides for secured attachment of the modular lift assembly to existing structures within an environment.

BRIEF SUMMARY OF THE INVENTION

The present invention provides an improved lift assembly that can be easily mounted within a theater or other performing arts venue. Moreover, the present invention provides an improved clamping mechanism allowing for easier and more effective clamping of modular lift assemblies to structures existing in the theater.

In an aspect of the invention, a lift assembly configured for attachment to two parallel support beams includes a chassis having a plurality of grooves formed in one surface thereof, at least one lift component attached to an opposing surface of the chassis, a telescoping stiffener and at least one attachment assembly. The telescoping stiffener is disposed in at least one of the grooves and engages facing surfaces of adjacent parallel support beams. The at least one attachment assembly is disposed in another of the grooves formed in the chassis for engaging at least one of the adjacent support beams.

In another aspect of the invention, a lift assembly for translating a load includes an elongated chassis, at least one first clip assembly, at least one second clip assembly, and a telescoping member. The at least one first clip assembly is disposed on the chassis to engage one of a pair of adjacent support beams. At least a portion of the first clip assembly is movable relative to the chassis. The at least one second clip assembly is disposed on the chassis to engage a second of the adjacent support beams. At least a portion of the second clip assembly is movable relative to the chassis. The telescoping member is disposed longitudinally on the chassis and is movable relative to the chassis. A first end of the telescoping member is in mechanical communication with the first clip assembly, and a second end of the telescoping member, opposite the first end, is in mechanical communication with the second clip assembly, such that movement of the first clip assembly and the second clip assembly relative to the chassis moves the telescoping member relative to the chassis.

In a further aspect of the invention, a theater lift assembly for raising and lowering objects relative to a stage includes an elongated chassis, at least one lifting drum attached to the chassis, at least two attachment assemblies connected to the chassis, and a telescoping support beam, extending longitudinally on and attached to the chassis along its length. The elongated chassis is configured for attachment to at least two parallel support beams positioned above the stage. The attachment assemblies are configured for attaching the chassis to the support beams. The telescoping support beam is configured to engage the support beam at its ends.

In a still further aspect of the invention, a lift assembly for raising and lowering a batten relative to a stage includes a chassis mountable to a pair of adjacent, substantially parallel support beams positioned above the stage, at least one first clip assembly disposed on the chassis, and a telescoping member disposed longitudinally on the chassis. The first clip assembly includes a first portion for engaging a side of a first of the adjacent support beams and a second portion for engaging a flange of the first of the adjacent support beams. The telescoping member has a first end for engaging the side of the first of the adjacent support beams and a first cutout proximate the first end for engaging the flange of the first of the adjacent support beams. At least one of (i) the first portion of the first clip assembly is substantially co-planar with the first end of the telescoping member, and (ii) the second portion of the first clip assembly is substantially co-planar with the first cutout of the telescoping member.

These and other features and advantages of the invention will be apparent with reference to the accompanying detailed description and figures, in which preferred embodiments of the invention are described and illustrated.

BRIEF DESCRIPTION OF THE SEVERAL VIEWS OF THE DRAWING(S)

Throughout the figures, like or corresponding reference numerals are used to illustrate like or corresponding features of the invention.

DETAILED DESCRIPTION OF THE INVENTION

A preferred embodiment of our invention will now be described with reference to FIGS. 2-5.

Figure 1A:
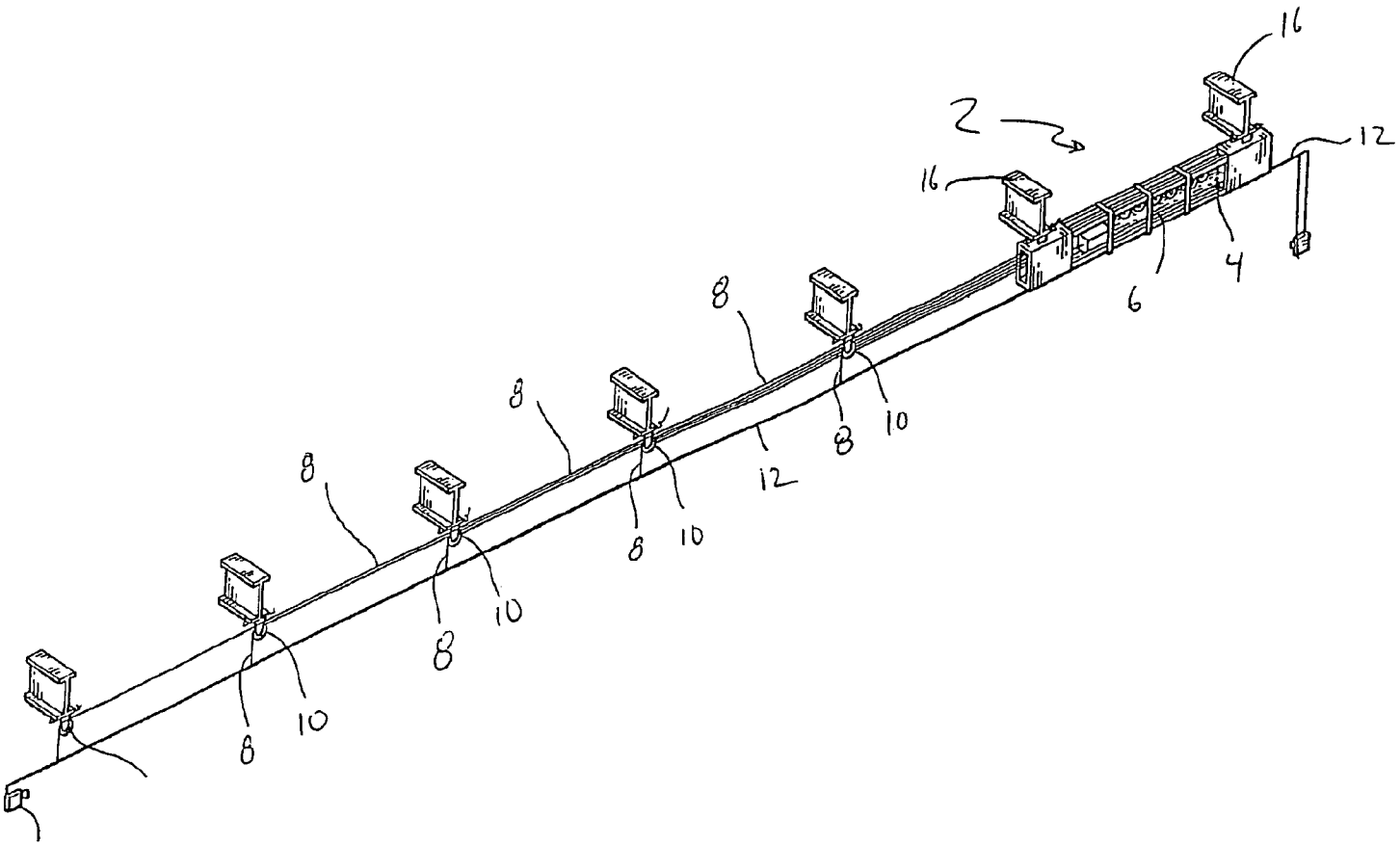
FIGS. 1A-1C are perspective views of a conventional lift assembly.
Figure 1B:
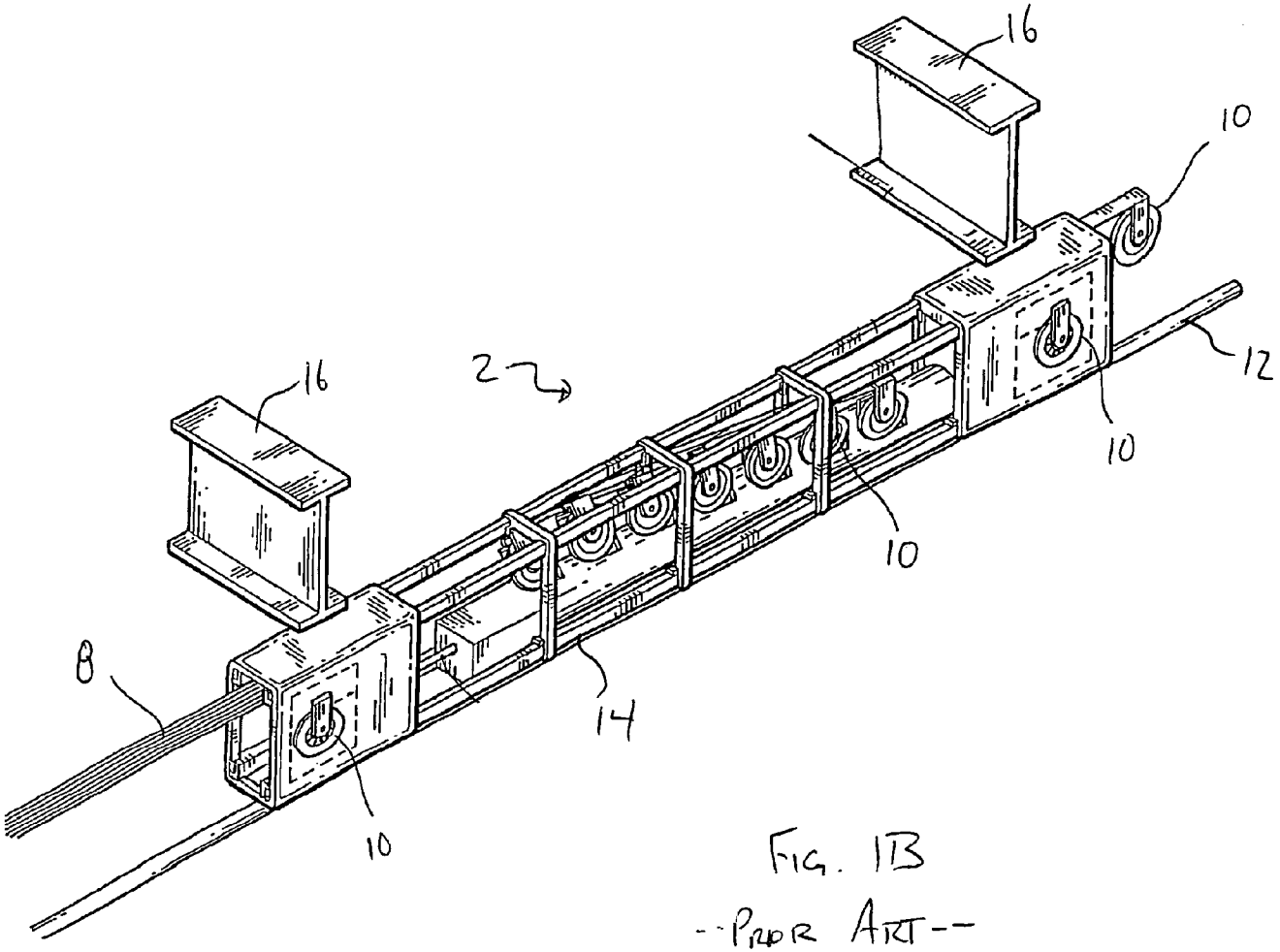
Figure 1C:
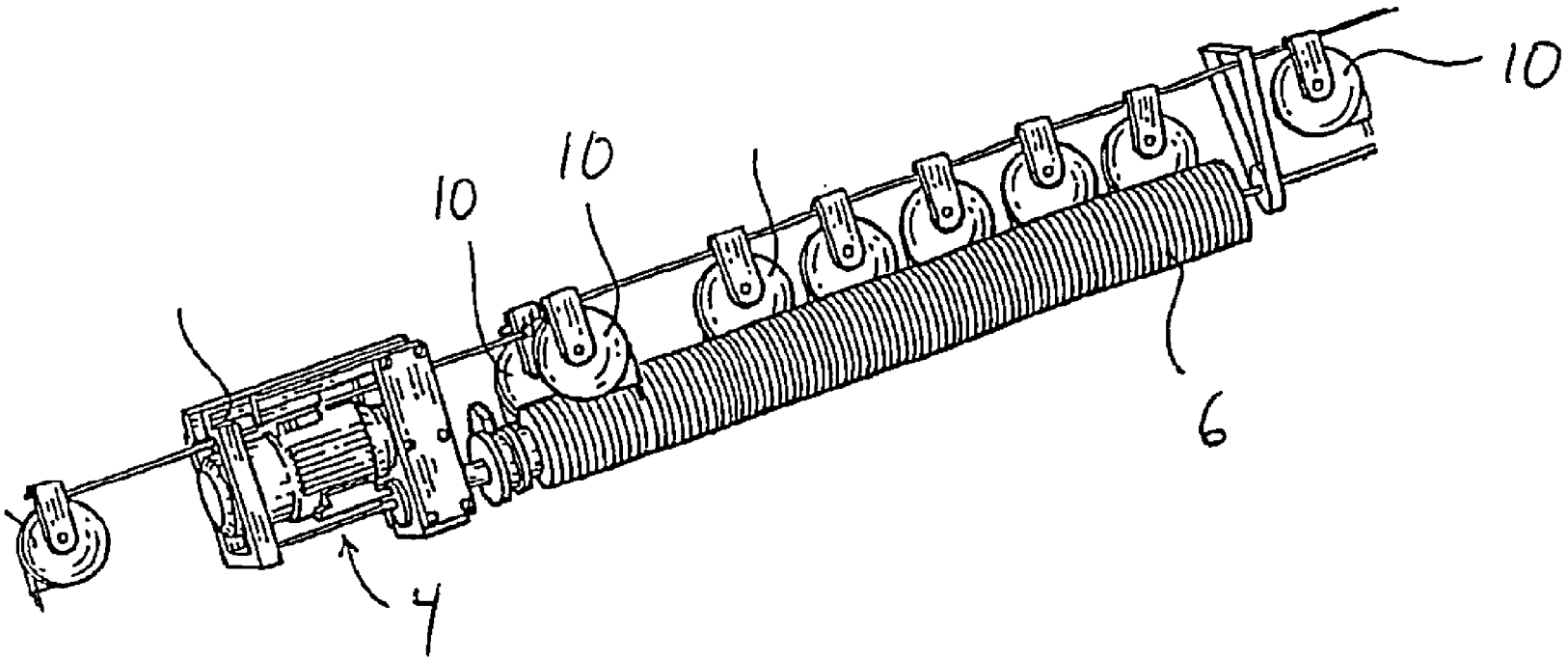
Figure 2:
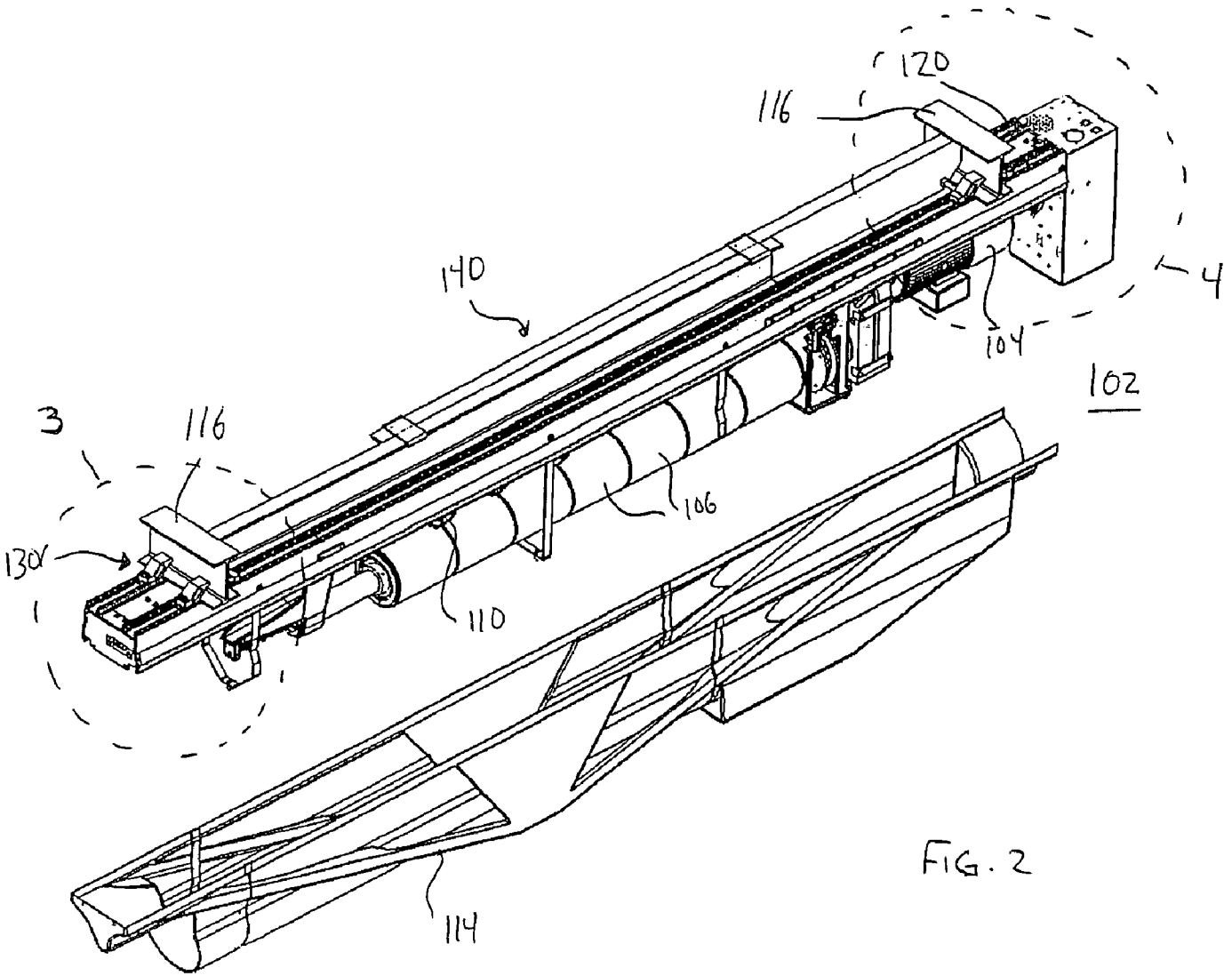
FIG. 2 is a perspective view of a lift assembly according to a preferred embodiment of the present invention.
Figure 3A:
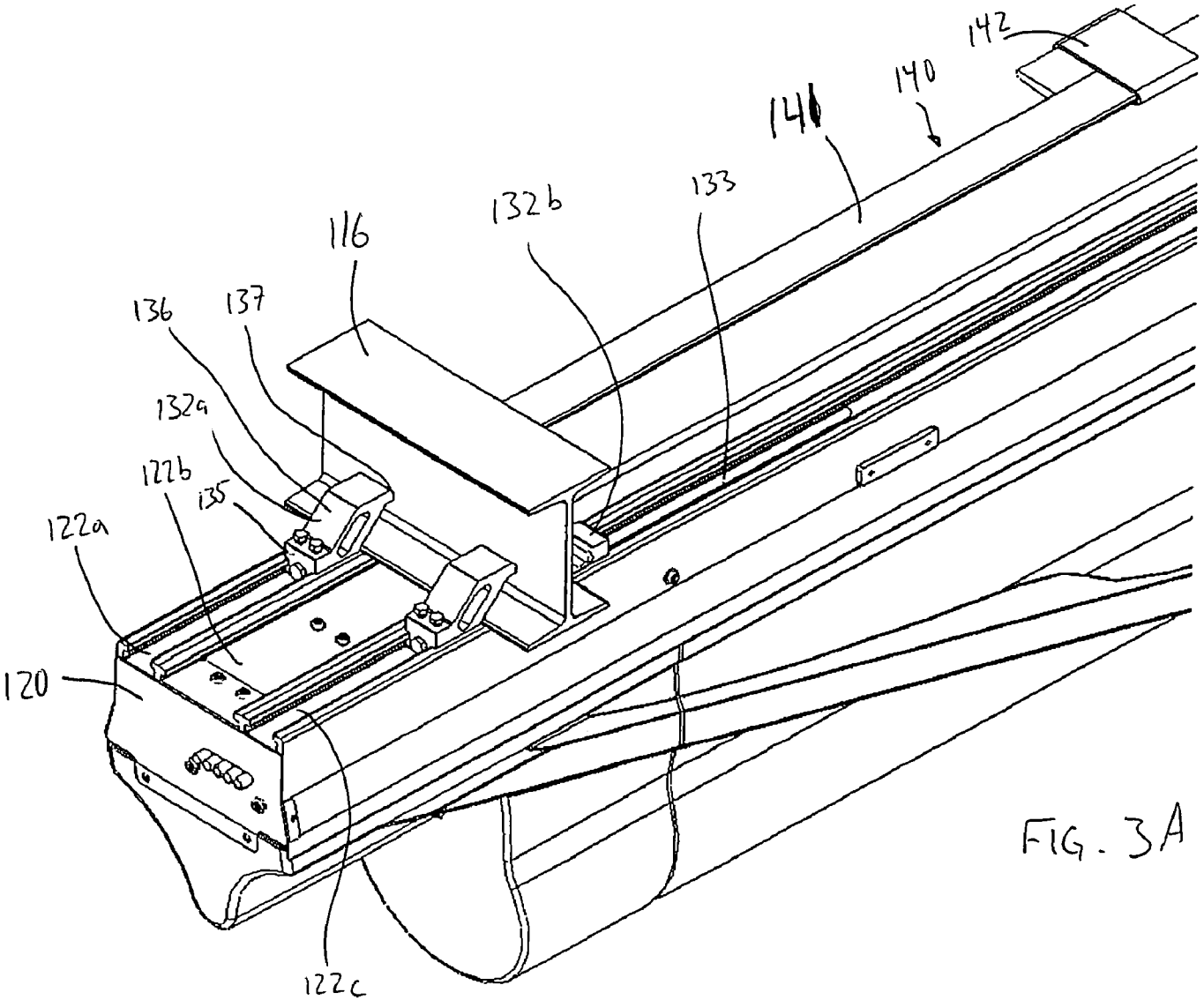
FIG. 3A is a close-up perspective view of section 3 of the lift assembly illustrated in FIG. 2.
Figure 3B:
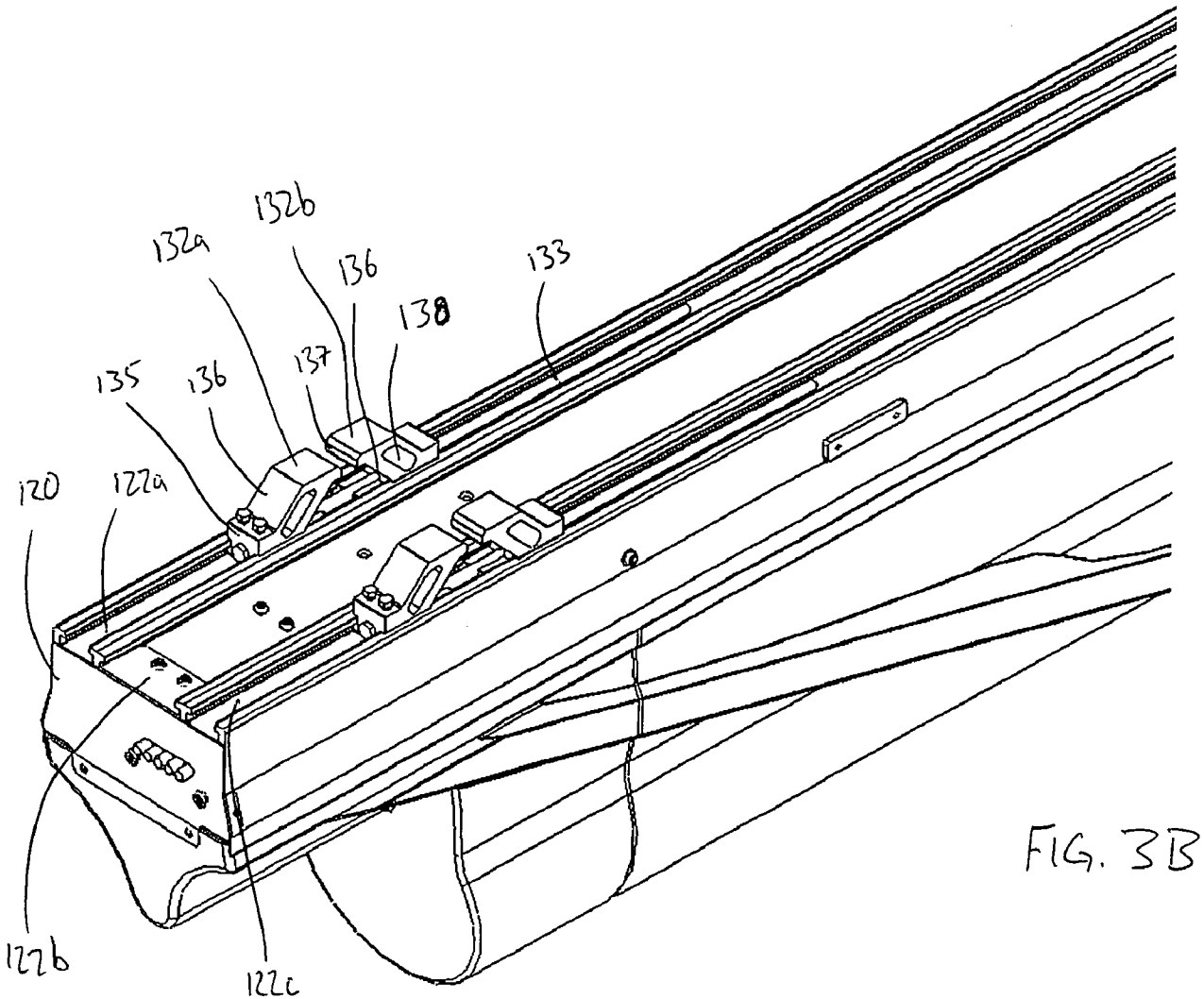
FIG. 3B is the view of FIG. 3A, with portions removed for clarity.
Figure 4:
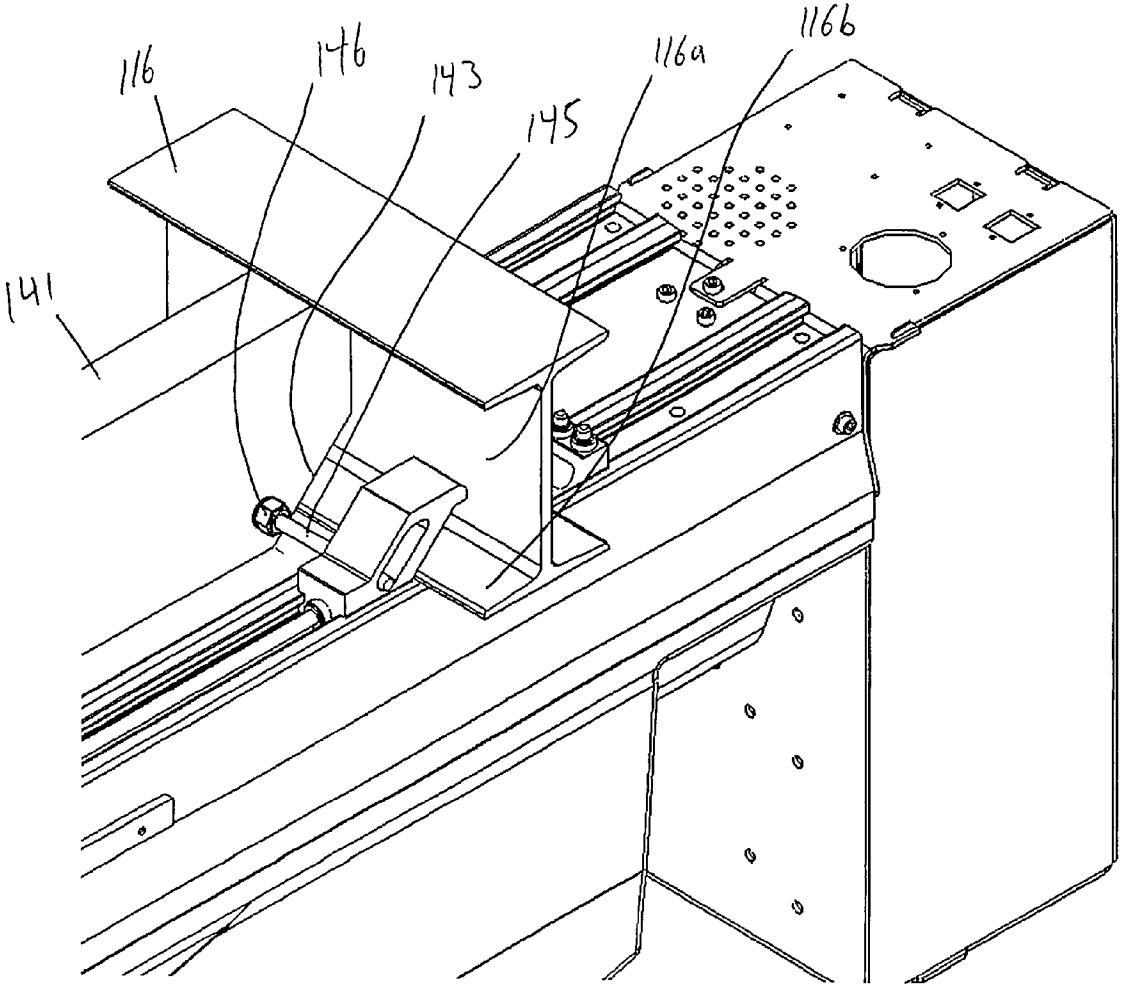
FIG. 4 is a close-up perspective view of section 4 of the lift assembly illustrated in FIG. 2.

Referring to FIG. 2, a lift assembly 1 of the present invention is provided for selectively raising and lowering a batten 8 relative to a stage or surrounding structure.

Although the term "batten" is generally used in connection with theatrical and staging environments, including scenery, staging, lighting equipment, and sound equipment, for example, it is understood that, as used herein, the term encompasses any load connectable to a windable cable.

The term "cable," as used herein, should be understood to encompass any wire, metal, cable, rope, wire rope or any other generally inelastic windable material.

The term "building," as used herein, should be understood to encompass any structure or facility to which the lift assembly is connected, such as, but not limited to, performance venues, theaters, arenas, concert halls, auditoriums, schools, clubs, educational institutions, stages, convention centers, television studios, showrooms, and places of religious gathering. Building is also understood to encompass cruise ships which may employ arenas.

Throughout this application, locational terms, such as, for example, top, bottom, side, inner, and outer, are used only to describe relative locations of features of the invention. Such terms are not limiting, inasmuch as it would e readily apparent to one of ordinary skill in the art that the features could be placed in different relative positions, without departing from the spirit and scope of the invention.

Referring to FIG. 2, a preferred lift assembly 102 of the subject invention includes a drive mechanism 104 arranged to rotate one or more rotatable drums 106. Cables (not shown) wound about the drums 106 are used in connection with pulleys 110 and/or other mechanisms to raise and lower a batten or similar load.

In the lift assembly 102, one or more of the drive mechanism 104, drums 106, and pulleys 110 preferably are attached to a chassis 120. The chassis 120 comprises a portion of a frame 114. The frame 114 and chassis 120 protect the components of the assembly from environmental contaminants, and encapsulate the moving parts of the assembly.

In addition to providing an attachment point for portions of the lift assembly 102, the chassis 120 also preferably supports structure for attaching the lift assembly to support structure, for example substantially parallel I-beams 116, native to the environment in which the lift assembly 102 is to be mounted. More specifically, the chassis 120 includes a plurality of grooves 122 formed on a top thereof, extending along the length thereof. In the preferred embodiment, for example, three grooves 122*a*, 122*b*, 122*c*, substantially t-shaped in cross-section, are provided along the length of the chassis. The three grooves include two outer grooves 122*a*, 122*c*, and an inner, or central groove 122*b*.

As described in more detail below, one or more attachment assemblies 130 are preferably disposed within the outer grooves 122*a*, 122*c*, and a telescoping member 140 is preferably disposed within the central slot 122*b*. As will also be described, the attachment assemblies 130 and/or the telescoping member 140 facilitate attachment of the chassis 120, and therefore the lift assembly 102, to existing I-beams 116 or similar structure commonly found in performing arts venues.

A novel attachment assembly 130 according to the preferred embodiment of our invention will be described first, with particular reference to FIGS. 3A, 3B, 4, and 5.

As illustrated, the attachment assembly 130 of the first embodiment of the invention includes a plurality of clip assemblies 131 for attaching the lift assembly to a pair of adjacent, substantially parallel I-beams 116. Preferably, two clip assemblies 131 are provided for attachment to each of adjacent I-beams 116. Thus, as shown in FIG. 2, four clip assemblies 131 are provided for attachment of the modular lift assembly 10 to the pair of adjacent I-beams.

Figure 6:
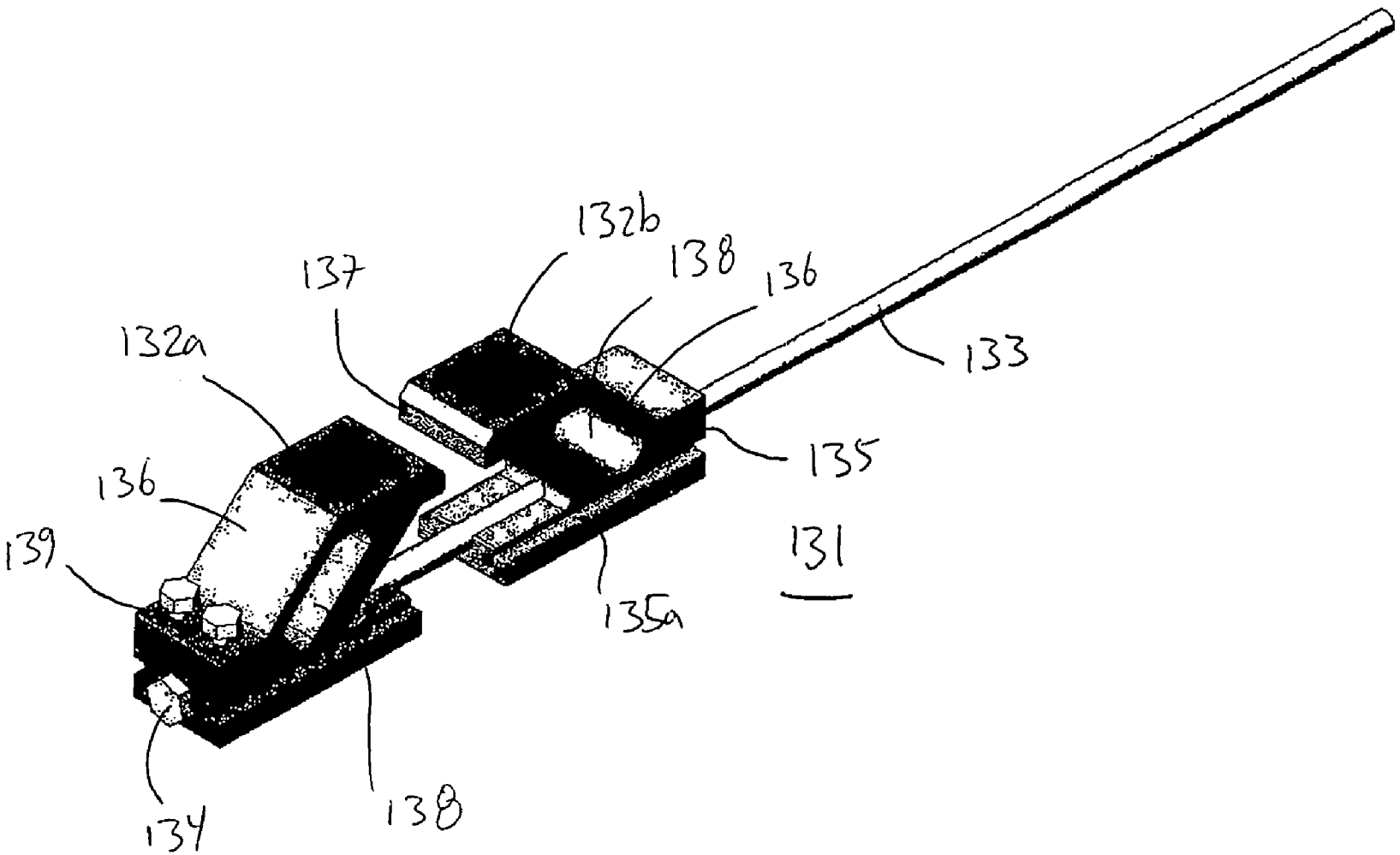
FIG. 6 is a perspective view of a clip assembly according to a preferred embodiment of the present invention.

A single clip assembly 131 is shown in, and will be described with particular reference to, FIG. 6. As illustrated therein, each clip assembly 131 includes a pair of jaws 132*a*, 132*b* and threaded member 133 having a head 134, e.g., a bolt, connecting the pair of jaws. Of the pair of jaws, one is preferably an outer jaw 132*a* and the other is an inner jaw 132*b*. As used herein, the terms outer and inner are used only as relative terms, used generally to describe the area outside an area bounded by two adjacent I-beams 116 existing in a performing arts environment, and the area bounded by the two adjacent I-beams 116, respectively. Thus, for example, vertical surfaces of the adjacent I-beams facing each other are inner surfaces, and a surface eon one of the adjacent I-beams that opposes an inner surface, i.e., facing opposite the inner surface, is an outer surface. Such terms are used only in their relative sense, and should not be construed as limiting of the invention.

The threaded member 133 is preferably attached to the outer jaw 132*a* with the inner jaw 132*b* threadably engaged with the threaded member 133. In this manner, when the outer jaw 132*a* is held stationary, rotation of the threaded member 133, i.e., via the head 134 of the member, which head may be a hex-head, flat head, Phillips head or the like, will result in selective loosening, i.e., widening of the distance between the outer and inner jaws, and tightening, i.e., narrowing of the distance between the outer and inner jaws, of the clip assembly.

Of course, the threaded member may be attached to the inner jaw, with the outer jaw threadably engaged with the threaded member. That is, the head of the threaded member may be arranged proximate the inner jaw. As will be described below, however, adjustment of the clip assembly to attach the lift assembly to I-beams is more easily done with the head of the threaded member disposed proximate the outer jaw.

As illustrated, the innerjaw 132*b* and outerjaw 132*a* preferably are substantially identical, with each jaw including a base 135, an intermediate, angled portion 136, and a distal flange 137. The jaws may also include a slot formed through the intermediate portion 135, the function of which will be described in more detail below. The base 135 of the jaws 132*a*, 132*b* includes horizontal channels 135*a* on either side thereof, positioned such that the jaw is receivable in one or more of the longitudinal, t-shaped grooves 122 formed along the length of the top of the chassis 120. Specifically, this base configuration allows the jaws to be slidable within the outer grooves 122*a*, 122*c* of the chassis 120, relative to the chassis 120. The intermediate portion 136 of the jaws preferably extends from the base at a substantially 45-degree angle, and terminates at the distal flange 137. As will be described in more detail below, when the jaws 132*a*, 132*b* are used to clamp an I-beam 116, the distal flange 137 contacts a sidewall 116*a* of the I-beam 116 and the intermediate portion 136 contacts a lower flange 116*b* of the I-beam 116.

Each outer jaw 132 also preferably includes one or more apertures 139 extending vertically therethrough. When the clip assembly 131 is disposed in one of the grooves 122 of the chassis 120, screws or similar fastening means are preferably passed through the apertures 139 to fix the jaw 132*a* with respect to the chassis 120. Threaded holes (not shown) may be provided in the chassis 120 to receive bolts passed through the apertures 139. Alternatively, self-tapping screws, set screws, or the like may be passed through the apertures 139 for engagement with the chassis. The inner jaws may also include the apertures 139, although it is generally not preferable to fix both the outer and inner jaws 132*a*, 132*b* to the chassis.

As shown in FIG. 2, four clip assemblies 131 are preferably provided to attach the lift assembly to the existing support structure, i.e., tow first clip assemblies 131*a* for engaging a first of two adjacent I-beams 116, and two second clip assemblies 131*b* for engaging the second of the I-beams 116.

The manner in which the lift assembly preferably is attached to the I-beams 116 will now be described. Preferably, the outer jaws 132*a* of the first clip assemblies 131*a* are fixed to the chassis, and the inner jaws 132*b* of the first clip assemblies 131*a* are spaced far enough from the outer jaws 132*a* to allow for acceptance of the first I-beam 116 between the outer and inner jaws 132*a*, 132*b*. Once the lift assembly is raised such that the top of the chassis 120 abuts the bottom of the first I-beam 116, the lift assembly 102 is placed such that the fixed outer jaws of the first clip assemblies 131*a* engage the first I-beam. In particular, the angled portion 136 contacts the lower flange 116*b* of the I-beam 116, and the distal flange 138 engages the sidewall 116*a* of the I-beam 116. The threaded members 133 of the first clip assemblies 131*a* are selectively tightened to decrease the distance between the outer jaws 132*a* and the inner jaws 132*b* of the first clip assemblies 131*a*, until the substantially 45° angled intermediate portions of each of the inner jaws 132*b* contacts the lower flange of the I-beam, and the distal flange of the each of the inner jaws contacts the inner sidewall 116*a* of the I-beam. In this manner, each of the first clip assemblies 131*a* contacts the I-beam 116 at opposite sidewalls 116*a*, i.e., inner and outer surfaces thereof, and at positions on the lower flange 116*b*.

As should be understood, because the outer jaws 132*a* of first clip assemblies 131*a* preferably are fixed to the chassis 120 prior to attachment of the lift assembly 102 or to the I-beams 116 the outer jaws 132*a* of second clip assemblies 131*b*, for engaging the second of the adjacent I-beams 116, cannot also be fixed to the chassis 120 prior to engaging the chassis 120 to the I-beams 116. Accordingly, the second clip assemblies 131*b* are freely slideable within the grooves of the chassis 120. When the first clip assemblies are in position to secure the chassis 120 to the first of the adjacent I-beams 116, as just described, the second clip assemblies 131*b* are moved within the slots such that the distal flange 137 of the outer jaws 132*a* of the second assemblies 131*b* contacts the outer a sidewall 116*a* of the second I-beam 116, and the intermediate, angled portions 136 of the outer jaws 132*a* contact the (outer) lower flange 116*b* of the second I-beam 116. So arranged, setscrews or self-tapping screws are inserted into the vertical apertures 139 formed in the base 135 of the outerjaws 132*a*, to fix the outer jaw 132 with respect to the chassis 120. The threaded member 133 of each of the second assemblies 131*b* is then rotated to clamp the outer jaws 132*a* and inner jaws 136 about the second of the adjacent I-beams 116, in substantially the same manner as which the first assemblies 131*a* were tightened about the first of the adjacent I-beams.

The foregoing discussion makes reference to fixing the outer jaws with respect to the chassis prior to clamping the clip assembly 131 on the I-beam. In this manner, the head of each of the clip assemblies is easily accessible from ends of the lift assembly, without having to access the area between the adjacent I-beams. Of course, it is also contemplated that the head of the threaded member be disposed proximate the inner jaw. In this manner the inner jaw may be fixed relative to the chassis and with the outer jaw being movable relative to the inner jaw.

While it is contemplated that the four clip assemblies shown in FIG. 2 will be sufficient to mount the modular assembly, it is also recognized that the increased distance between the adjacent I-beams and/or increased load to be raised and lowered by the lift assembly may result in deformation of one or more components of the modular assembly. More specifically, and as discussed in more detail above, increased bending of the modular assembly about one or both of the I-beams may result from both vertical and horizontal loads on the lift assembly resulting from the weight of the lift assembly and the load to be raised and lowered.

Figure 5:
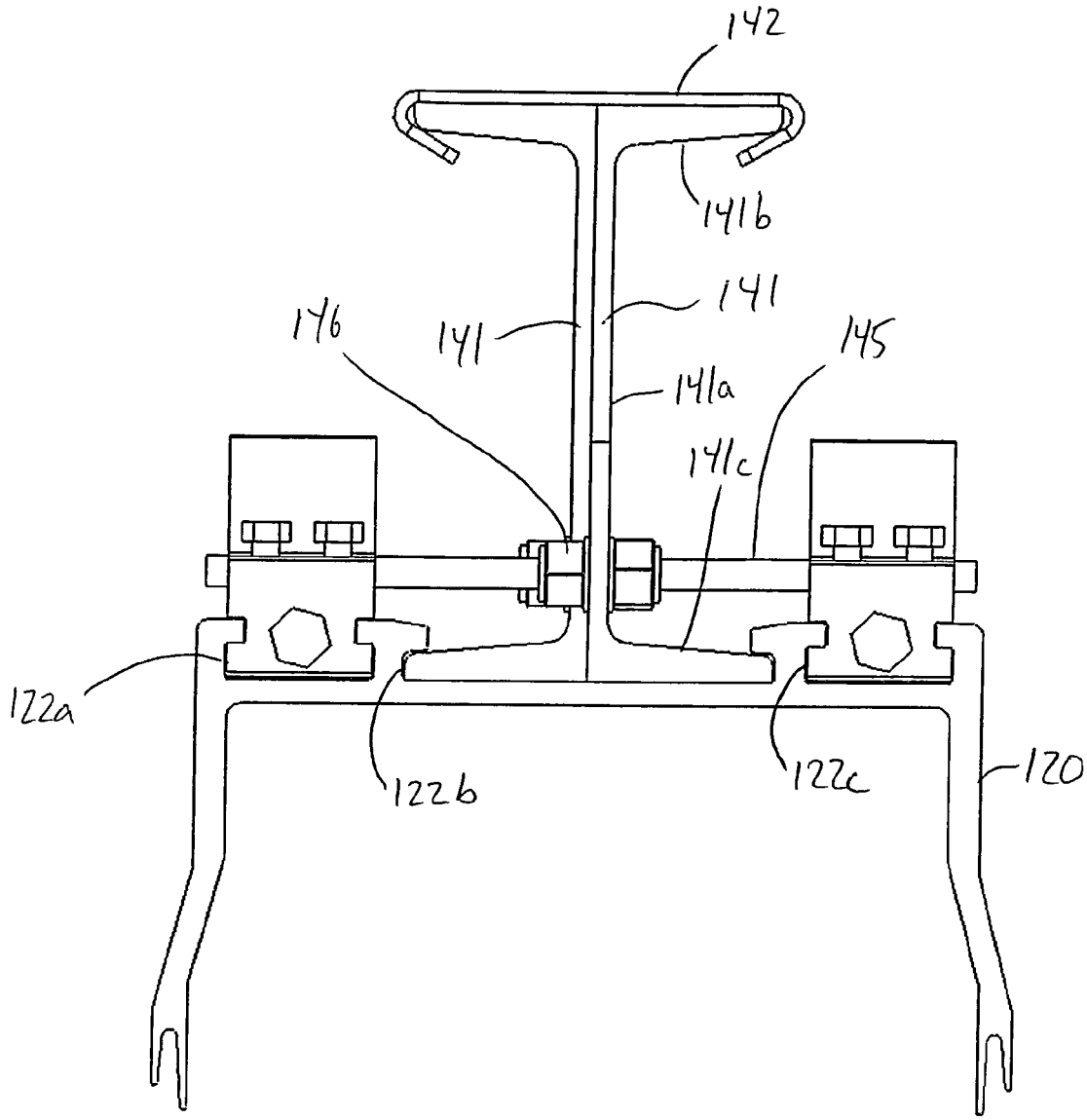
FIG. 5 is an end-view of the lift assembly of claim 2, with portions of the assembly removed for clarity.

Accordingly, in the preferred embodiment, our invention also includes a telescoping member 140 disposed in the central groove 122*b* on the top of the chassis 120. As shown in FIG. 2, the telescoping member 140 according to the present invention includes two substantially C-shaped channels 141 arranged back-to-back, each channel including a substantially vertical spine 141*a* and upper and lower flanges 141*b*, 141*c* depending substantially horizontally from upper and lower ends, respectively, of the vertical spine 141*a*. When arranged back-to-back, the channels 141 form a substantially I-shaped cross-section, as shown in FIG. 5. The lower flanges 141*c* of the back-to-back channels are received within the central groove 122*b* of the chassis, and are slidable within that groove. The channels 141 are slidable relative to the chassis 120, and relative to each other. Clips 142 may be provided to maintain the orientation of the two channels 141 with respect to each other, for example, by engaging the upper flanges 141*b* of the C-shaped channels 141. Preferably, the clips 142 serve only as guides to maintain the orientation of the channels 141, and do not impede relative movement of the channels 141.

Substantially 45-degree cutouts 143 are formed at the bottom of distal ends of the channels 141 forming the telescoping member 140. Preferably, each of the cutouts forms an angle substantially identical to the angle forwarded by the intermediate portion 136 of the innerjaws 132*b* of the clip assemblies 131.

When the chassis 120 is mounted to adjacent I-beams 116 native to the environment in which the lift assembly 102 is to be mounted, the two channels 141 comprising the telescoping member 140 are moved relative to each other to make the telescoping member 140 longer, until the distal ends of the telescoping member 140 contact the adjacent I-beams 116. Specifically, at least a portion of the distal end of each channel 141 contacts the sidewall 116*a* of the beam 116, while the angled cutout 143 contacts the lower flange of the existing I-beam 116.

Thus, as described in this preferred embodiment of our invention, clip assemblies 131 and a telescoping member 140 are provided for attachment of a modular lift assembly to existing adjacent I-beams in a performing arts venue. As should be appreciated because the angle of the cutout formed at the distal ends of the telescoping member mimics the angle of the intermediate portion of the jaws of the clip assemblies, each of the angled cutouts contacts the lower flange of an existing I-beam in the same manner in which the intermediate portion of the innerjaws of the clip assemblies contacts the lower flange at the I-beam. Moreover, the distal ends of the telescoping member contact facing sidewalls of the adjacent I-beams in the same manner in which the distal flanges of the inner jaws of the multiple clip assemblies contact the facing sidewalls of the adjacent I-beams. As also should be appreciated, the telescoping member is attached to the chassis along the entire length of the chassis between the adjacent I-beams. In this manner, the telescoping member serves as a rigid backbone for the lift assembly, substantially countering rotational and translational loads applied to the lift assembly and support structure.

The clip assemblies and the telescoping member may operate independently of one another, thereby requiring adjustment of each of these features. Alternatively, the clip assemblies and telescoping member operate as a single assembly. More specifically, as shown in the figures, in a portion of the telescoping member proximate to the cutout regions formed at the distal ends thereof a through-hole or aperture 144 is formed. Preferably, a threaded rod 145 is passed through this aperture 144 (the aperture may be threaded to receive the threaded rod) and nuts 146 are threaded onto either side of the rod 145 to stabilize the rod 145. The distal ends of the rod extend transversely from either side of the channel 141 through which the rod 145 is passed. These ends of the rod 145 are disposed within the horizontal slots 138 formed through the intermediate portions 136 of the inner jaws 132*b* of adjacent clip assemblies 131.

With this configuration, when the clip assemblies 131 are tightened, i.e., the inner jaw is moved closer to the outer jaw, the distal end of the telescoping member will move with the inner jaw. Thus, tightening of one bolt will result in clamping of the clip assembly and will extend the telescoping member. By repeating this process on both ends of the assembly, a secure and reliable mounting of the modular assembly to the existing I-beams is achieved.

The mechanical connection of the telescoping member to the clip assemblies may also preferably insure (i) that the ends of the telescoping member are substantially co-planar with the distal flange of the inner jaws of adjacent clip assemblies and (ii) that the cutout portion is substantially co-planar with the intermediate portion of the inner jaws. Thus, maximum engagement is achieved between the telescoping member, clip assemblies, and I-beams.

Of course, modifications to the preferred embodiments also are contemplated.

For example, the telescoping member is not limited to the back-to-back channel construction. For example, the members comprising the member need not be C-shaped in cross-section. L-Shaped, substantially square, rectangular, or any number of other cross-sections may be used. Regardless of the cross-sections used, the members preferably are disposed on the chassis to support the chassis, and are movable with respect to each other and with respect to the chassis. Of course, when different cross-sections are used for the channels forming the telescoping member, the formation of the clips will vary.

Moreover, although the grooves 122 formed in the chassis 120 are described as being T-shaped in cross-section, such is not necessary. Any number of cross-sections may be used, so long as the clip assemblies and/or the telescoping member are receivable therein. For example, the grooves may have any cross-section including linear and/or curvilinear surfaces. Moreover, the grooves for receiving the clip assemblies may be different in cross-section than the grooves for receiving the telescoping member.

Additionally, the grooves 122, although described as being formed on a top of the chassis, may alternatively be formed on the side or bottom of the chassis, without departing from the spirit and scope of the invention. Alternative groove locations may require that the attachment assemblies and/or the telescoping member include extensions or the like to contact the inwardly facing sides of the I-beams, and/or the lower flanges as described above.

As described above, a slot 138 is preferably formed through the intermediate portion of each of the inner and outer jaws. The slot 138 serves to accept longitudinal ends of the rod connected to the telescoping member, to mechanically couple the telescoping member to an adjacent clip member. However, the slot also is preferably formed to reduce vibration of the lift assembly. Specifically, the slot is dimensioned taking into account the natural frequency of the lift assembly, and acts to dampen noise created in the lift assembly.

Furthermore, in the preferred embodiments described above, a rod extends longitudinally from the telescoping member and is received in an adjacent clip assembly to provide a mechanical connection between the telescoping member and clip assemblies. However, any number of means maybe used to couple the telescoping member to one or more clip assemblies. For example, such coupling means may include bolts, screws, rivets, or any other mechanical connection.

The embodiments discussed above are representative of embodiments of the present invention and are provided only for illustration. The embodiments are not intended to limit the scope of the invention. Variations and modifications are apparent from a reading of the preceding description and are included within the scope of the invention. The invention is intended to be limited only by the scope of the accompanying claims.

The invention claimed is:

1. A lift assembly configured for attachment to two parallel support beams, the lift assembly comprising:

a chassis having a plurality of grooves formed in one surface thereof;

at least one lift component attached to an opposing surface of the chassis;

a telescoping stiffener disposed in at least one of the grooves and engaging facing surfaces of adjacent parallel support beams; and at least one clip assembly disposed in another of the grooves formed in the chassis for engaging at least one of the adjacent support beams.

2. The lift assembly according to claim 1, wherein a corresponding number of grooves are provided in the chassis for a plurality of clip assemblies arranged to engage one of the support beams.

3. The lift assembly according to claim 1, wherein the telescoping stiffener comprises two substantially C-shaped channels arranged back-to-back.

4. The lift assembly according to claim 3, wherein a lower flange of each of the back-to-back members is disposed in the at least one groove of the chassis, one or both of the back-to-back members being slidable in the groove, relative to the chassis.

5. The modular lift assembly according to claim 1, wherein ends of the telescoping stiffener that engage the support beams include a notch forming a beam-contacting surface to engage a lower flange of the adjacent support beams.

6. The modular lift assembly according to claim 1, wherein the at least one clip assembly comprises two jaws arranged facing each other and movable relative to each other.

7. The modular lift assembly according to claim 6, wherein the two jaws are connected by a threaded member, and the threaded member is rotatable to selectively open and close the jaws.

8. The modular lift assembly according to claim 6, wherein the two jaws include an inner jaw, disposed between the adjacent support beams, and an outer jaw disposed on a side of the support beam to be engaged by the clip assembly opposite the inner jaw.

9. The modular lift assembly according to claim 8, wherein the outer jaw is fixed relative to the chassis and the internal jaw moves relative to the fixed outer jaw.

10. The modular lift assembly according to claim 1, wherein the telescoping member is mechanically coupled to a movable portion of at least one of the clip assemblies such that movement of the movable portion of the clip assembly correspondingly moves the telescoping stiffener.

11. The lift assembly according to claim 1, wherein the grooves are substantially T-shaped in cross-section, and the telescoping stiffener and the at least one clip assembly have structure acceptable in the T-shaped cross-section.

12. A lift assembly for translating a load in an environment, the lift assembly comprising:

an elongated chassis;

at least one first clip assembly disposed on the chassis to engage one of a pair of adjacent support beams, at least a portion the first clip assembly being movable with respect to the chassis;

at least one second clip assembly disposed on the chassis to engage a second of the adjacent support beams, at least a portion of the second clip assembly being movable with respect to the chassis; and a telescoping member disposed longitudinally on the chassis and movable relative to the chassis, a first end of the telescoping member being in mechanical communication with the first clip assembly, and a second end of the telescoping member, opposite the first end, being in mechanical communication with the second clip assembly, such that movement of the first clip assembly and the second clip assembly relative to the chassis moves the telescoping member relative to the chassis.

13. The lift assembly according to claim 12, wherein the first clip assembly and the second clip assembly engage a portion of the support beam to secure the chassis to the beams.

14. The lift assembly according to claim 13, wherein each of the first clip assembly and the second clip assembly comprises opposing jaws having a base portion for disposing the jaws on the chassis, an angled intermediate portion that contacts a lower flange of the support beams, and an outer flange that contacts a side of the support beams to secure the chassis to the support beams.

15. The lift assembly according to claim 12, wherein the first clip assembly and the first end of the telescoping member engage the first of the adjacent support beams and the second clip assembly and the second end of the telescoping member engage the second of the adjacent support beams to secure the lift assembly to the adjacent support beams.

16. The lift assembly according to claim 12, wherein the portion of the first and second clip assemblies movable relative to the chassis include an aperture therethrough.

17. The lift assembly according to claim 16, wherein the telescoping member further comprises an appendage depending therefrom, to be received in the apertures formed in the first and second clip assemblies.

18. A theater lift assembly for raising and lowering objects relative to a stage, the lift assembly comprising:

an elongated chassis configured for attachment to at least two parallel support beams positioned above the stage;

at least one lifting drum attached to the chassis;

at least two attachment assemblies connected to the chassis and configured for attaching the chassis to the support beams; and a telescoping support beam, extending longitudinally of and attached to the chassis along its length and configured to be attached to the support beam at its ends.

19. A lift assembly for raising and lowering a batten relative to a stage, the lift assembly comprising:

a chassis mountable to a pair of adjacent, substantially parallel support beams positioned above the stage;

at least one first clip assembly disposed on the chassis, the first clip assembly including a first portion for engaging a side of a first of the adjacent support beams and a second portion for engaging a flange of the first of the adjacent support beams;

a telescoping member disposed longitudinally on the chassis, the telescoping member having a first end for engaging the side of the first of the adjacent support beams and a first cutout proximate the first end for engaging the flange of the first of the adjacent support beams, wherein at least one of (i) the first portion of the first clip assembly is substantially co-planar with the first end of the telescoping member, and (ii) the second portion of the first clip assembly is substantially co-planar with the first cutout of the telescoping member.

20. The lift assembly according to claim 19, wherein the first clip assembly includes an outer jaw and an inner jaw movable relative to the outer jaw, the inner jaw including an outer flange comprising the first portion of the first clip assembly for contacting the side of the one of the adjacent support beams and an angled portion comprising the second portion of the first clip assembly for contacting the flange of the one of the adjacent support beams.

21. The lift assembly according to claim 19, further comprising at least one second clip assembly disposed on the chassis, the second clip assembly including a first portion for engaging a side of a second of the adjacent support beams and a second portion for engaging a flange of the second of the adjacent support beams, wherein the telescoping member has a second end for engaging the side of the second of the adjacent support beams and a second cutout proximate the second end for contacting the flange of the second of the adjacent support beams, and wherein at least one of (i) the first portion of the second clip assembly is substantially co-planar with the second end of the telescoping member, and (ii) the second portion of the second clip assembly is substantially co-planar with the second cutout of the telescoping member.

22. The lift assembly according to claim 21, wherein both the first clip assembly and the second clip assembly includes an outer jaw and an inner jaw movable relative to the outer jaw, the inner jaw including an outer flange comprising the first portion of the respective clip assembly for contacting the respective side of the adjacent support beams and an angled portion comprising the second portion of the respective clip assembly for contacting the flange of the respective adjacent support beams.

* * * * *